United States Patent [19]

Meier et al.

[11] Patent Number: 4,569,605

[45] Date of Patent: Feb. 11, 1986

[54] WIRE DRIVING ARMATURE FOR DOT PRINTER

[75] Inventors: Johann H. Meier, Vestal, N.Y.; David W. Hanna, Charlotte, N.C.

[73] Assignee: International Business Machines Corporation, Armonk, N.Y.

[21] Appl. No.: 576,312

[22] Filed: Feb. 2, 1984

[51] Int. Cl.[4] ..... B41J 3/00; B41J 3/10

[52] U.S. Cl. ..... 400/124; 400/174; 101/93.05

[58] Field of Search ..... 400/118, 121, 124, 174, 400/157.1; 101/93.04, 93.05

[56] References Cited

U.S. PATENT DOCUMENTS

| | | | |
|---|---|---|---|
| 3,770,092 | 11/1973 | Grim | 197/1 R |
| 3,892,175 | 7/1975 | Heindke et al. | 101/93.05 |
| 4,005,770 | 2/1977 | Hirose et al. | 400/124 |
| 4,230,412 | 10/1980 | Hebert | 400/124 |
| 4,244,658 | 1/1981 | Mori | 400/124 |
| 4,401,392 | 8/1983 | Blomquist et al. | 400/124 |

FOREIGN PATENT DOCUMENTS

| | | | |
|---|---|---|---|
| 55-86771 | 6/1980 | Japan . | |
| 0120356 | 9/1981 | Japan | 400/124 |
| 0083464 | 5/1982 | Japan | 400/124 |
| 0087374 | 5/1982 | Japan | 400/124 |
| 0045964 | 3/1983 | Japan | 400/124 |
| 0131073 | 8/1983 | Japan | 101/93.05 |
| 0166068 | 10/1983 | Japan | 400/124 |

*Primary Examiner*—Edgar S. Burr
*Assistant Examiner*—James R. McDaniel
*Attorney, Agent, or Firm*—Bell, Seltzer, Park & Gibson

[57] ABSTRACT

The multi-wire dot print head is provided with a plurality of print wires with a wire driving armature associated with each of the print wires and being operable to move the print wire toward a print position. The wire driving armatures each include an actuator lever and a cylindrical movable core mounted intermediate opposite ends of the actuator lever with an electromagnetic actuator associated with each of the armatures for imparting movement thereto. The outer end of the actuator lever is provided with a downwardly depending pivot leg and pivot or fulcrum support means for the actuator lever is positioned in a plane below the level of the open end of a cylindrical bore in the electromagnetic actuator so that a minimum amount of clearance may be provided between the cylindrical core and the cylindrical bore.

3 Claims, 4 Drawing Figures

WIRE DRIVING ARMATURE FOR DOT PRINTER

FIELD OF THE INVENTION

This invention relates generally to a dot printer head and more particularly to an improved print wire driving armature construction and pivotal support for providing maximum force to be developed for moving the print wires toward the printing position while permitting the use of a small size electromagnetic coil and armature.

BACKGROUND OF THE INVENTION

Matrix dot wire printers have been in use for some years and often include a circular arrangement of electromagnets which are selectively energized to attract a cylindrical movable core mounted intermediate opposite ends of a print wire actuator lever. The magnetic gap between the fixed core and the movable core is small but provides a longer stroke to the print wire because of the mechanical advantage provided by the pivoting actuator lever. Examples of this general type of dot printer head are disclosed in U.S. Pat. Nos. 3,770,092; 3,892,175; and 4,244,658.

The actuator levers of the prior art type of dot printer are pivotally supported at their outer ends and extend inwardly across the electromagnetic coils with the inner ends of the actuator levers engaging the ends of the print wires and moving them toward a print position when the corresponding electromagnetic actuator is energized. When the cylindrical movable core moves into and out of the electromagnetic coil, it follows an arcuate path of movement in the cylindrical bore in the electromagnetic coil or actuator. In prior art types of dot printer heads, the pivotal support of the actuator lever is provided in a plane which is normal to the cylindrical bore and positioned above the open end of the cylindrical bore in the electromagnetic actuator so that a substantially large circumferential clearance must be provided between the outer periphery of the cylindrical movable core and the inner periphery of the cylindrical bore of the electromagnetic actuator. This large clearance reduces the electromagnetic efficiency of the print actuator. This reduced efficiency in turn tends to adversely affect the size of the print head, the energy it requires, and the heat it genertates in operation.

SUMMARY OF THE INVENTION

With the foregoing in mind, it is an object of the present invention to provide a small size multi-wire dot print head in which improved print wire driving armature and pivot support means is provided to permit maximum magnetic force to be developed during arcuate penetrating movement of the cylindrical movable core of the actuator lever into the cylindrical bore of the electromagnetic actuator. To this end, the location of the pivotal support or fulcrum point of the actuator lever is positioned in a plane which is normal to the cylindrical bore and intermediate the level of the open upper end of the cylindrical bore in the electromagnetic coil and the position of maximum penetration of the cylindrical movable core so that a minimum of circumferential clearance may be provided between the cylindrical movable core and the cylindrical bore of the electromagnetic actuator.

In accordance with the present invention, the pivoted outer end of the actuator lever is provided with a downwardly depending pivot portion or leg so that the pivotal location of the outer end portion of the actuator lever is positioned below the upper level of the bore in the electromagnetic coil. This positioning of the pivot or fulcrum point below the upper level of the open end of the cylindrical bore in the electromagnetic coil reduces the amount of transverse movement of the movable core as it is drawn into and moves outwardly of the bore of the electromagnetic coil and thereby permits a minimum amount of circumferential clearance to be provided between the cylindrical movable core and the cylindrical bore of the electromagnetic coil. This reduced amount of clearance provides an efficient magnetic coupling with a consequent savings of energy, space and heat.

The dot print head of the present invention includes a metallic cup in which the electromagnetic coils are supported in spaced relationship. The metallic cup forms an electromagnetic flux force yoke for constraining the magnetic field of each coil and directing it in a closed circuit through the actuator lever to thereby maximize the intensity of the magnetic flux through the movable core. Thus, the only gap in the magnetic flux path occurs inside of the electromagnetic coil and between the inner end of the cylindrical movable core and the inner end of the fixed core therein, when the actuator lever is raised to the rest position. The upper rim of the metallic cup forms the pivot or fulcrum surface for the actuator arms of each of the electromagnetic coils. The upper flange of the coil bobbin is provided with an integrally molded extension surrounding the outer end of the actuator lever and extending outwardly over the upper rim of the metallic cup to provide a pivot constraint for the outer end of the actuator lever. The pivot constraint integral with the coil bobbin provides a close dimensional relationship between the actuator lever and the bobbin and allows the clearance between the cylindrical bore of the bobbin and the movable core to be further minimized. The downwardly extending pivot leg of the actuator lever is of substantially the same width as the width of the upper edge of the metallic cup and the lower surface of the downwardly extending pivot leg is cut at a slight angle so that it is substantially flush with and in surface contact with the upper surface of the cup when the actuator lever is in the raised or nonprint position so that a very efficient flux pattern or path is provided thereby permitting a relatively strong magnetic force to be produced by a relatively small electromagnetic coil.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 2:
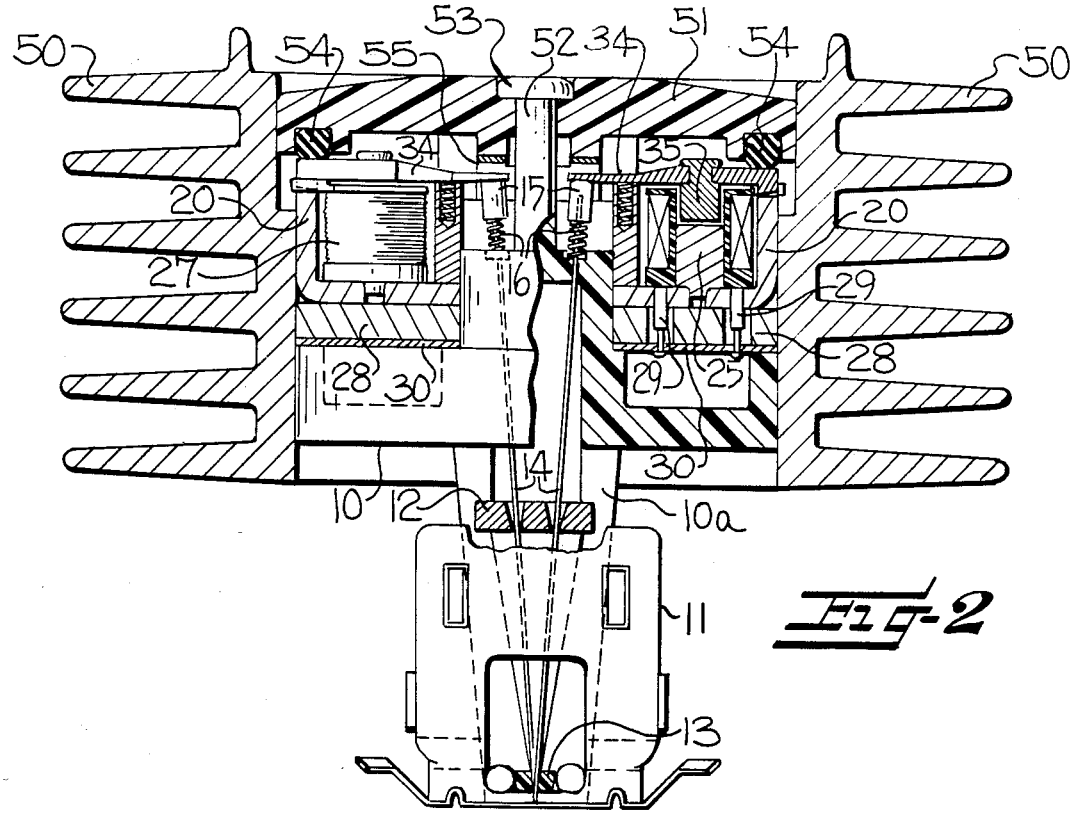
FIG. 2 is an enlarged vertical sectional view taken substantially along the line 2—2 in FIG. 1.
Figure 3:
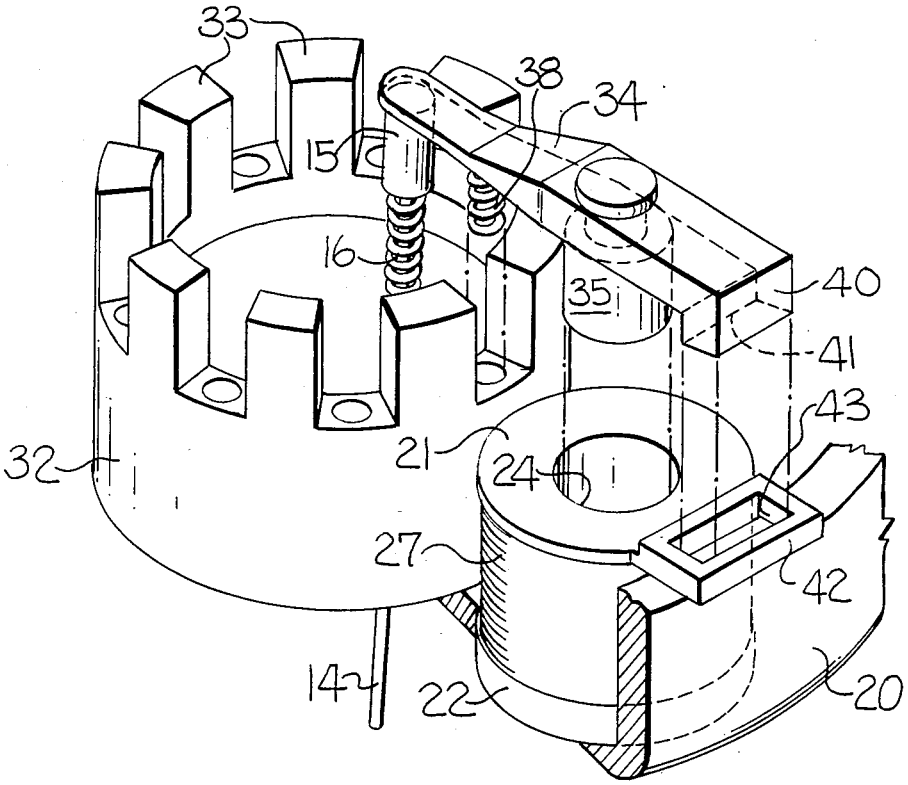
FIG. 3 is a fragmentary isometric view illustrating the electromagnetic coil and actuator lever associated with one of the print wires.

The present multi-wire dot print head, as illustrated in the drawings, includes a molded main support frame 10 with a downwardly depending support leg 10*a* supporting a ribbon guide 11 and upper and lower print wire guide plates 12, 13 (FIG. 2). The lower ends of print wires 14 are supported for vertical sliding movement in the guides 12, 13 and the upper ends thereof extend through guide openings in an upstanding hub portion of the main frame 10. Enlarged impact heads 15 are fixedly connected to the upper ends of the wires 14 and compression springs 16 surround the upper ends of the print wires 14 and normally urge the print wires to an upper or nonprint position.

A magnetic flux conducting or constraining yoke, in the form of a metallic cup 20, surrounds and is supported on the upstanding hub of the main frame 10 (FIG. 4) and supports electromagnetic actuators around the inner peripheral surface thereof. The electromagnetic actuators each include a bobbin with an upper flange 21, a lower flange 22 and a barrel 23 having an inner cylindrical bore 24 which is open at its upper end. A fixed metallic core 25 is supported in the lower portion of the open bore 24 and its lower end is fixed in the cup 20. Wire windings form a coil 27 around the barrel 23. The coil 27 is electrically connected to operator means for energizing the same through contacts 29 extending through a spacer plate 28 (FIG. 2) and joined to the end 30 of a flexible cable 31.

Figure 4:
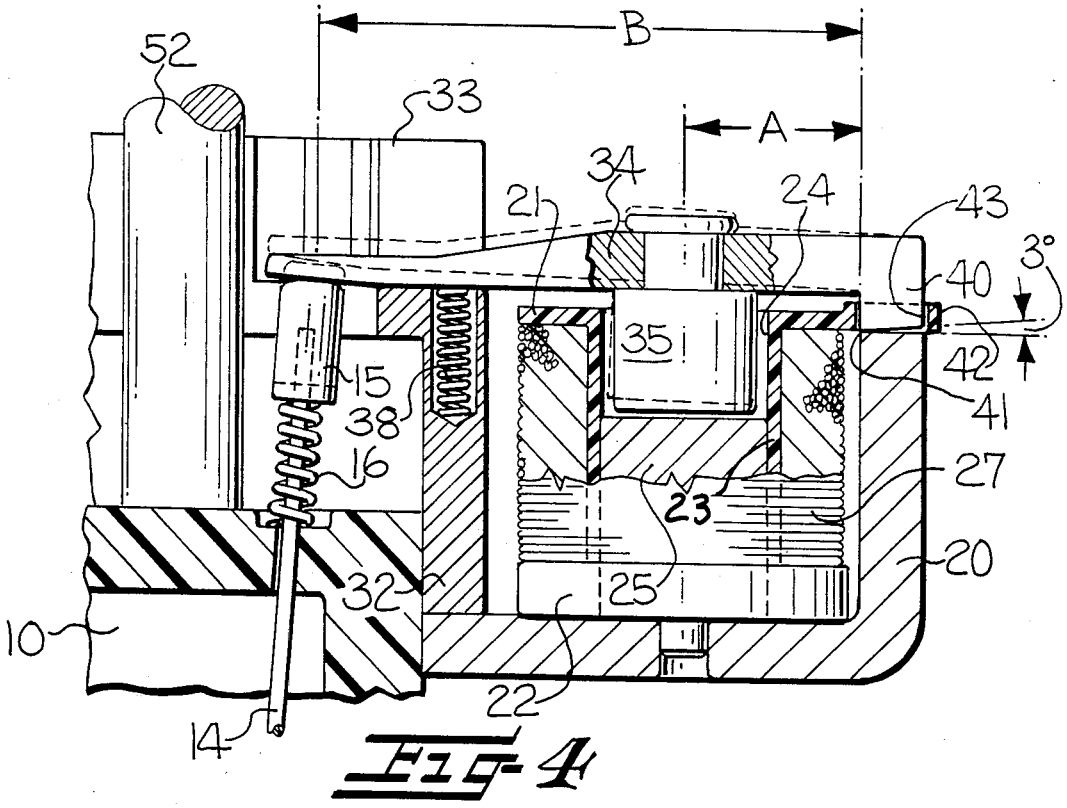
FIG. 4 is an enlarged vertical sectional view through one of the electromagnetic coils and associated actuator levers and with the actuator lever being shown in the print position in solid lines and in the nonprint position in dotted lines.

An actuator lever guide sleeve 32 surrounds and extends upwardly from the upstanding hub of the main frame 10 and the upper portion thereof is provided with notched openings 33 in which the inner end portions of the print wire driving armatures are positioned. The print wire driving armatures each include a radially extending magnetically permeable actuator lever 34 and a cylindrical movable core 35 mounted intermediate opposite ends of the actuator lever 34 and extending downwardly therefrom. The inner end of the actuator lever 34 engages and rests upon the enlarged drive head 15 of the print wire 14 and a compression spring 38 is supported in a suitable bore in the sleeve 32 and the upper end engages and urges the inner end portion of the actuator lever 34 upwardly to the nonprint or dotted line position shown in FIG. 4. The outer end of the actuator lever 34 is provided with a downwardly extending pivot leg 40 and the lower surface of the pivot leg 40 is cut at an angle of approximately three degrees, as indicated in FIG. 4, from the horizontal and relative to the upper end of the upper surface of the cup 20 so that the pivot or fulcrum point of the outer end of the actuator lever 34 is located at the inner edge portion of the cup 20, as indicated at 41 in FIG. 4. The armature pivot support 41 is positioned normal to the cylindrical bore 24 and intermediate the level of the open end of the cylindrical bore 24 and the position of maximum penetration of the movable core 35, and is illustrated in FIG. 4 as being approximately one-fifth of this distance.

The upper flange 21 is provided with an integrally molded extension in the form of an upwardly extending open frame 42 which is thicker than the upper flange 21 and is provided with a rectangular opening 43 for closely surrounding and confining the lower portion of the pivot leg 40 of the actuator lever 34 in direct alignment with the upper surface of the upstanding wall of the cup or yoke 20. The extension 42 and opening 43 thus forms a pivot positioning means for the pivoting of the outer end of the actuator lever 34. When the lever 34 is in the raised or nonprint position, the lower surface of the pivot leg 40 closely engages the upper rim of the metal cup 20 to provide a closed circuit and an efficient flux path for the magnetic field of the electromagnetic actuator.

Figure 1:
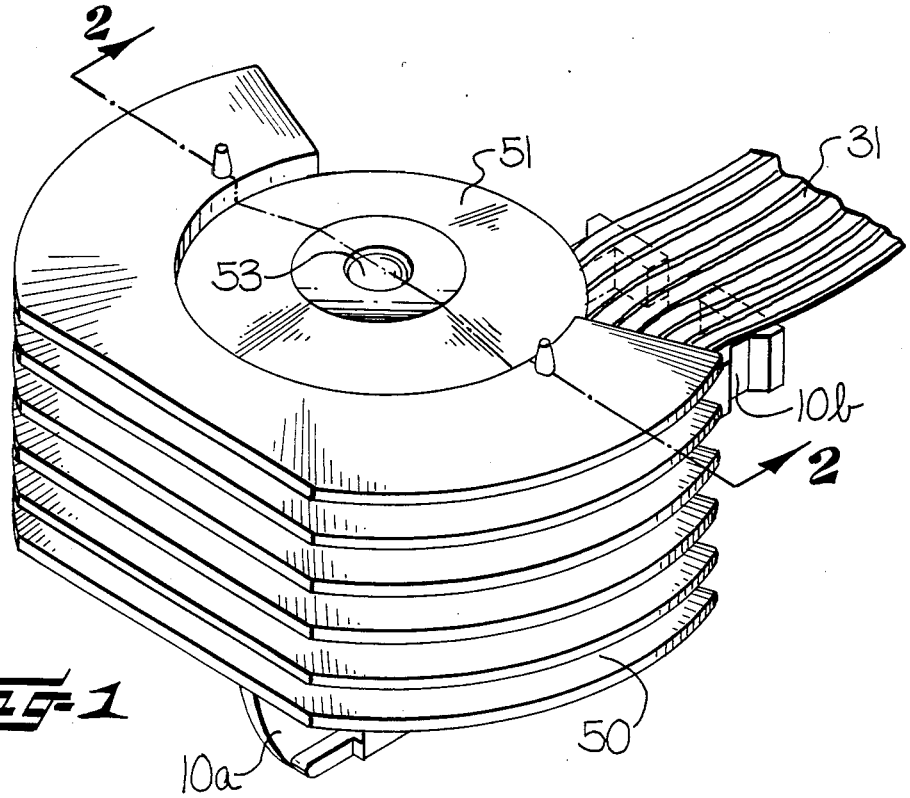
FIG. 1 is an isometric view looking downwardly on the dot print head of the present invention.

A finned outer housing 50 (FIGS. 1 and 2) closely surrounds the main frame 10 and extends around the same. The finned housing 50 is preferably formed of a heat conducting metal, such as aluminum, and provides a heat sink for dissipating heat generated by the operation of the electromagnetic actuators in the print head. A cap 51 surrounds an upstanding post 52 integral with the main frame 10 and extending upwardly from the hub thereof. After assembly, a head 53 is formed on post 52 into a recess in cap 51 in order to retain the cap against sleeve 32. An O-ring 54 is supported in an annular groove in the lower surface of the cap 51 and bears against the outer ends of the actuator levers 34 to resiliently maintain the vertical pivot legs 40 in firm contact with the upper surface of the cup 20. An energy absorbing stop ring 55 (FIG. 2) is supported below the cap 51 and forms an upper stop and damper for the inner ends of the actuator levers 34. To aid in transfer of heat from the coils 27 to the heat sink 50, it is preferred that a potting compound, not shown, be positioned around the coils 27. This potting compound may be poured into the cup 20 to surround the coils 27 and set in rigid or semi-rigid condition.

As best shown in FIG. 4, the vertical center lines of the movable cylindrical core 35 and the fixed core 25 are axially aligned and concentric. When the coil 27 is energized, a magnetic field is produced within the coil and attracts the movable core 25 inwardly against the fixed core 25. The strength of the magnetic field is greatest when the gap between the movable core 35 and the fixed core 25 is positioned within the middle one-third of the windings of the coil 27.

The distance from the pivot or fulcrum point 41 of the actuator lever 34 to the center of the movable core 35, as indicated by the dimension A in FIG. 4, is approximately one-third of the overall length of the dimension from the pivot point of the actuator lever 34, as indicated by the dimension B in FIG. 4. Thus, a lever ratio of approximately three to one is provided to increase the displacement and thus the velocity imparted to the upper end of the print wire 14. Since the pivot or fulcrum point 41 of the actuator lever 34 is positioned in a plane normal to the cylindrical bore 24 and intermediate the open upper end of the cylindrical bore 24 and the position of maximum penetration of the cylindrical movable core 35, the amount of transverse or lateral movement of the cylindrical movable core 35 is very small when the actuator lever 34 moves between the nonprint and print positions and vice versa. With such a small amount of arcuate or lateral movement of the movable core 35, a minimum amount of circumferential clearance may be provided between the cylindrical movable core 35 and the cylindrical bore 24 of the electromagnetic actuator. By lowering the pivot or fulcrum point 41 of the lever 34 below the open upper end of the bore 24 of the bobbin, as opposed to providing a pivot or fulcrum point above the level of the bobbin, the amount of transverse or lateral movement of the movable core 35 is considerably reduced when the actuator lever 34 moves between the print and nonprint positions so that a minimum amount of circumferential clearance can be provided between the movable core 35 and the bore 24.

The multi-wire dot print head of the present invention thus includes actuator levers 34 with the pivot support point 41 at the outer end of each of the actuator levers 34 being positioned below the plane of the open end of the cylindrical bore 24 of the electromagnetic actuators so that a minimum of clearance may be provided between the cylindrical movable core 35 and the cylindrical bore 24 of the electromagnetic actuator. This repositioning of the pivot support point for the actuator levers permits a highly efficient magnetic force to be applied to the levers and the print wires and permits a minimization of the size of the electromagnetic coil, thereby permitting a minimized consumption of energy in operating the print wires, as well as a minimized amount of heat being generated by the print head.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A multi-wire dot print head comprising a frame, a plurality of print wires supported for longitudinal sliding movement in said frame, a wire driving armature associated with each of said print wires and including a pivotally mounted actuator lever having an outer end with a downwardly depending pivot leg defining a pivot on the lower surface thereof, an inner end engaging said print wire, and a cylindrical core mounted intermediate said ends, an electromagnetic actuator associated with each of said armatures for imparting pivotal movement thereto to thereby move the associated print wire, said electromagnetic actuators each having a cylindrical bore that is open at the upper end thereof for receiving said cylindrical core therein, each of said electromagnetic actuators including a bobbin with upper and lower bobbin flanges, a metal cup surrounding said electromagnetic actuators and including a flat upper edge terminating below the level of said open upper end of said cylindrical bore, said upper edge of said metal cup providing pivot support means on which said pivot on the lower surface of said downwardly depending pivot leg of said actuator lever is supported and defining a fulcrum for the pivotal movement of said actuator lever, an open frame extension integrally formed with said upper bobbin flange and extending over the upper edge of said cup and providing pivot positioning means closely surrounding and confining said pivot on the lower surface of said downwardly depending pivot leg of said actuator lever, said pivot support means lying in a plane normal to said cylindrical bore and being defined by said upper edge of said metal cup and below the open end of said cylindrical bore so that a minimum of clearance may be provided between said cylindrical core and said cylindrical bore of said electromagnetic actuator.

2. A multi-wire dot print head according to claim 1 wherein said pivot leg includes a flat lower surface, and wherein said flat lower surface of said vertically extending pivot leg is cut at an angle of approximately three degrees relative to said flat upper edge of said cup so that the entire flat lower surface engages said flat upper edge of said cup when said inner end of said actuator lever is in a raised and nonprint position.

3. A multi-wire dot print head according to claim 1 wherein said pivot support means is positioned approximately one-fifth of the distance from the open end of said cylindrical bore to the position of maximum penetration of said cylindrical movable core in said cylindrical bore.

* * * * *